US011931784B2

(12) United States Patent
Pacher et al.

(10) Patent No.: US 11,931,784 B2
(45) Date of Patent: Mar. 19, 2024

(54) ROLLING MILL FOR SOLID ELONGATED PRODUCTS

(71) Applicant: SMS GROUP S.p.A., Tarcento (IT)

(72) Inventors: Marcello Pacher, Tarcento (IT); Nicola Maria Tuzio, Tarcento (IT); Paolo Marin, Tarcento (IT)

(73) Assignee: SMS GROUP S.P.A., Tarcento (IT)

( * ) Notice: Subject to any disclaimer, the term of this patent is extended or adjusted under 35 U.S.C. 154(b) by 0 days.

(21) Appl. No.: 17/496,505

(22) Filed: Oct. 7, 2021

(65) Prior Publication Data

US 2022/0111428 A1 Apr. 14, 2022

(30) Foreign Application Priority Data

Oct. 8, 2020 (IT) ..... 102020000023761

(51) Int. Cl.
*B21B 13/02* (2006.01)

(52) U.S. Cl.
CPC ..... *B21B 13/02* (2013.01)

(58) Field of Classification Search
CPC ..... B21B 13/10; B21B 13/103; B21B 17/14; B21B 31/10; B21B 31/26; B21B 35/04
See application file for complete search history.

(56) References Cited

U.S. PATENT DOCUMENTS

2013/0036784 A1* 2/2013 Marin ..... B21B 13/10 72/224

FOREIGN PATENT DOCUMENTS

| | | | | |
|---|---|---|---|---|
| DE | 693 02 789 T2 | | 11/1996 | |
| DE | 10307199 B3 | * | 8/2004 | ..... B21B 13/103 |
| EP | 1 449 597 A2 | | 8/2004 | |
| EP | 2 560 771 B1 | | 7/2014 | |
| EP | 2 983 840 B1 | | 6/2017 | |
| WO | 2009/141414 A1 | | 11/2009 | |

OTHER PUBLICATIONS

Machine Translation of DE 10307199B3 (Year: 2004).*
Italian Search Report for Italian Patent Application No. 1102020000023761 dated Jun. 1, 2021, 4 pages.

* cited by examiner

*Primary Examiner* — Debra M Sullivan
(74) *Attorney, Agent, or Firm* — Merchant & Gould P.C.

(57) ABSTRACT

A rolling mill for solid elongated products, defining a rolling axis, including first and second rolling stations. Each station includes a load-bearing structure, a removable roll-holder cartridge with three rolling rolls movable radially and rotating around spaced rotational axes, and a roll having a vertical rotational axis. A system synchronizes mechanical adjustment of the rolls. Three actuators mount on the load-bearing structure; three gear motor groups connect to the rolls by single extensions. The second station rolls are rotated 60° from the first stations. The rolls with a vertical axis of the first and second stations are arranged on opposite sides of the rolling axis. All rolling stations allow lateral extraction of roll-holder cartridges from the same side of the rolling mill. The stations on the extraction side have actuators movable relative to the load-bearing structure. The stations with vertical rolls arranged on the opposite side have fixed actuators.

17 Claims, 14 Drawing Sheets

PRIOR ART

PRIOR ART

PRIOR ART

ROLLING MILL FOR SOLID ELONGATED PRODUCTS

CROSS-REFERENCE TO RELATED APPLICATION

This application claims benefit of Serial No. 10202020000023761, filed 8 Oct. 2020, and which application is incorporated herein by reference. To the extent appropriate, a claim of priority to made to the above-disclosed application.

FIELD OF APPLICATION

The present invention relates to a rolling mill for solid elongated products, such as for example bars, rods and wire rods.

Advantageously, the rolling mill according to the invention is intended in particular to carry out a finishing rolling.

PRIOR ART

The longitudinal rolling of solid elongated products has been carried out for several years by multi-cage rolling mills with motorized rolls.

A multi-cage rolling mill comprises a plurality of rolling stations arranged in series along the rolling axis. Each station comprises a plurality of rolling rolls inserted in a roll-holder cartridge or cage.

Generally, each cage is provided with three rolls, although solutions with two or four-roll cages have been proposed. Operationally, the position of the rolls of each cage may be adjusted by changing the radial distance of each roll from the rolling axis so as to be able to vary the rolling action as a function of the diameter to be obtained on the elongated product being processed.

The term "finishing rolling" is used herein to refer to that step in the processing of elongated products in the steel industry, such as for example bars, rods, or wire rods, in which an elongated semi-finished product is subjected to longitudinal rolling by rolls up to its final size. This processing essentially leads to a reduction in the size of the semi-finished product until its nominal value is reached.

As is known, the rolling rolls are subject to wear and damage and must be regularly replaced. Therefore, in the operational management of the rolling mills, an easy replacement of the rolls becomes essential.

Generally, in multi-cage rolling mills, the replacement of a roll is carried out by first extracting the respective cage from the structure of the rolling mill.

Typically, multi-cage rolling mills are configured for lateral extraction of the cages, that is, obtainable through a movement of the cages orthogonal to the rolling axis.

Multi-cage rolling mills are known which allow the lateral extraction of all the cages from the same side of the rolling mill. This is very advantageous as it simplifies the logistics of managing the cages themselves.

An example of a multi-cage rolling mill with extraction of all the cages from the same side is shown in FIGS. 1 and 2.

More in detail, the rolling mill generally comprises four or five cages placed in series along the rolling axis. Each cage S is provided with three rolls R1, R2 and R3 equally distributed at 120° with respect to one another about the rolling axis X. One of the three rolls R1 has a horizontal axis of rotation. The odd cages have the rolls rotated by 60° about the rolling axis with respect to the even ones in order to roll the material with the groove bottom of the respective rolls at the portion of the product which in the previous cage was not affected by the action of the rolls. With this configuration, the odd cages are overturned with respect to the even ones about a horizontal axis. Each roll is provided with its own adjustment actuator A1, A2 and A3, in particular of the hydraulic type, mounted on the fixed structure F of the rolling mill. The actuators A1, A2 and A3 have the purpose of adjusting the radial distance of each roll from the rolling axis so as to be able to vary the rolling action as a function of the diameter to be obtained on the elongated product being processed. The adjustment actuators are radially aligned with the respective rolls and are therefore equally distributed at 120° about the rolling axis X. In the configuration illustrated, one of the three actuators is therefore arranged along the vertical direction passing through the rolling axis. FIGS. 1 and 2 show a section of the rolling mill at an even cage.

The control system of the rolling mill comprises a single motor M for each cage, which is connected to the respective rolls by a three-output gear distributor group RD. The horizontal axis roll R1 is connected directly to the distributor gear group by a kinematic connection extension L1, while each of the two inclined rolls R2 and R3 is connected to the distributor gear group RD by a double extension L2+L2' and L3+L3' interspersed with a special angular gearbox G2, G3. The motors and the distributor gear groups of the different cages are all positioned on the same side of the rolling mill, so as to leave the opposite side free for the extraction of the cages. During the cage extraction step to allow the creation of a free path for the movement of the cage, the hydraulic actuator A2 of the roll R2 positioned on the cage extraction side is rotatable (in the figures it is shown in a rotated non-operative condition) so that it may be temporarily moved from the extraction path.

Although such rolling mill solution is effective, it nevertheless has some limitations.

The control system is complex and expensive, comprising for each cage a three-output distributor gear group RD and special angular gearboxes G2 and G3 with an angle between the input and output shaft of approximately 50°-60°.

Furthermore, the special angular gearbox G2 which is arranged below the rolling mill and which is connected to the respective roll with an extension L2' at 30° with respect to the vertical is inevitably hit by the drainage of the cooling water. Once the gearbox G2 is reached, the water then infiltrates the lubrication system, thus reaching the other gearboxes. This causes corrosion problems affecting not only the double extension L2+L2' and the lower angular gearbox G2, but all gearboxes, imposing heavy maintenance costs.

A second example of a rolling mill with lateral extraction of the cages on the same side is illustrated in FIGS. 3 and 4. This rolling mill adopts a general configuration of the rolls and of the control system similar to that present in the rolling mill of FIG. 1. The radial adjustment system of the rolls is, however, integrated on board each roll-holder cartridge and consists of a mechanical adjustment system suitable to synchronously adjust the radial movements of the rolls. The motion to the adjustment system is provided by an external control C mounted on the fixed structure of the rolling mill on the extraction side of the cages. Such external control C is rotatable with respect to the fixed structure F so as to create a free path for the extraction of the cages.

Even in this solution, however, the aforementioned limits remain, linked to the complexity and cost of the control system and to the presence of special angular gearboxes placed under the rolling mill and therefore exposed to the drainage of the cooling water.

To overcome the aforementioned limits, multi-cage rolling mills have been proposed with:

- simplified control system which includes a gear motor group for each roll of each cage and a kinematic connection extension between the gear motor group and the respective roll without special angular gearboxes;
- (hydraulic) roll adjustment actuators, external to the cages and fixedly associated with the structure of the rolling mill;
- different arrangement of the three rolls inside the cages.

Multi-cage rolling mills of this type are described for example in WO2009141414A1 and EP2560771B1.

More in detail, each cage is provided with three rolls, equally distributed at 120° with respect to one another about the rolling axis. One of the three rolls has a vertical rather than a horizontal axis of rotation. The odd cages have the rolls rotated by 60° about the rolling axis with respect to the even ones. Each roll is provided with its own adjustment actuator, in particular of the hydraulic type, mounted on the fixed structure of the rolling mill. The adjustment actuators are radially aligned with the respective rolls and are therefore equally distributed at 120° about the rolling axis with one of them being therefore arranged along the horizontal direction passing through the rolling axis. By virtue of this arrangement of the rolls, as well as of the absence of special angular gearboxes arranged under the rolling mill, problems related to the infiltration of water into the lubrication system are avoided.

The extraction of each cage takes place on the side opposite to that where the roll with vertical axis is located, after having cleared the path by moving the connection extension of one of the inclined rolls. With this configuration, however, the extraction of the cages may not take place on the same side of the rolling mill, but alternatively, i.e. even cages on one side and odd cages on the other.

Therefore, the rolling mills described in WO2009141414A1 and EP2560771B1, in the face of a significant simplification of the plant, do not have the operational advantages linked to the fact of being able to extract all the cages from the same side of the rolling mill.

To date, there are no multi-cage rolling mills that allow the extraction of all the cages from the same side of the rolling mill and at the same time have a simplified roll control system that does not require special angular gearboxes.

In the field of rolling mills for solid elongated products, the differentiation of roll calibrations requires roll changes more frequently. For this reason, in this field there is a greater need to have multi-cage rolling mills which combine the possibility of extracting all the cages from the same side with a simplified roll control system which does not require special angular gearboxes.

DISCLOSURE OF THE INVENTION

Therefore, the main object of the present invention is to eliminate or at least mitigate the drawbacks of the aforementioned prior art by providing a rolling mill for solid elongated products which combines the possibility of extracting all the cages from the same side with a simplified roll control system which does not require special angular gearboxes.

A further object of the present invention is to provide a rolling mill for solid elongated products which is constructively simple to manufacture, with substantially lower manufacturing costs than traditional solutions which allow all the cartridges to be extracted from the same side of the rolling mill.

BRIEF DESCRIPTION OF THE DRAWINGS

The technical features of the invention, according to the aforesaid objects, may clearly be seen in the content of the claims below, and its advantages will become more readily apparent in the detailed description that follows, made with reference to the accompanying drawings, which illustrate one or more purely exemplary and non-limiting embodiments thereof, in which:

Elements or parts of elements in common to the embodiments described below are referred to with the same reference numerals.

DETAILED DESCRIPTION

Figure 1:
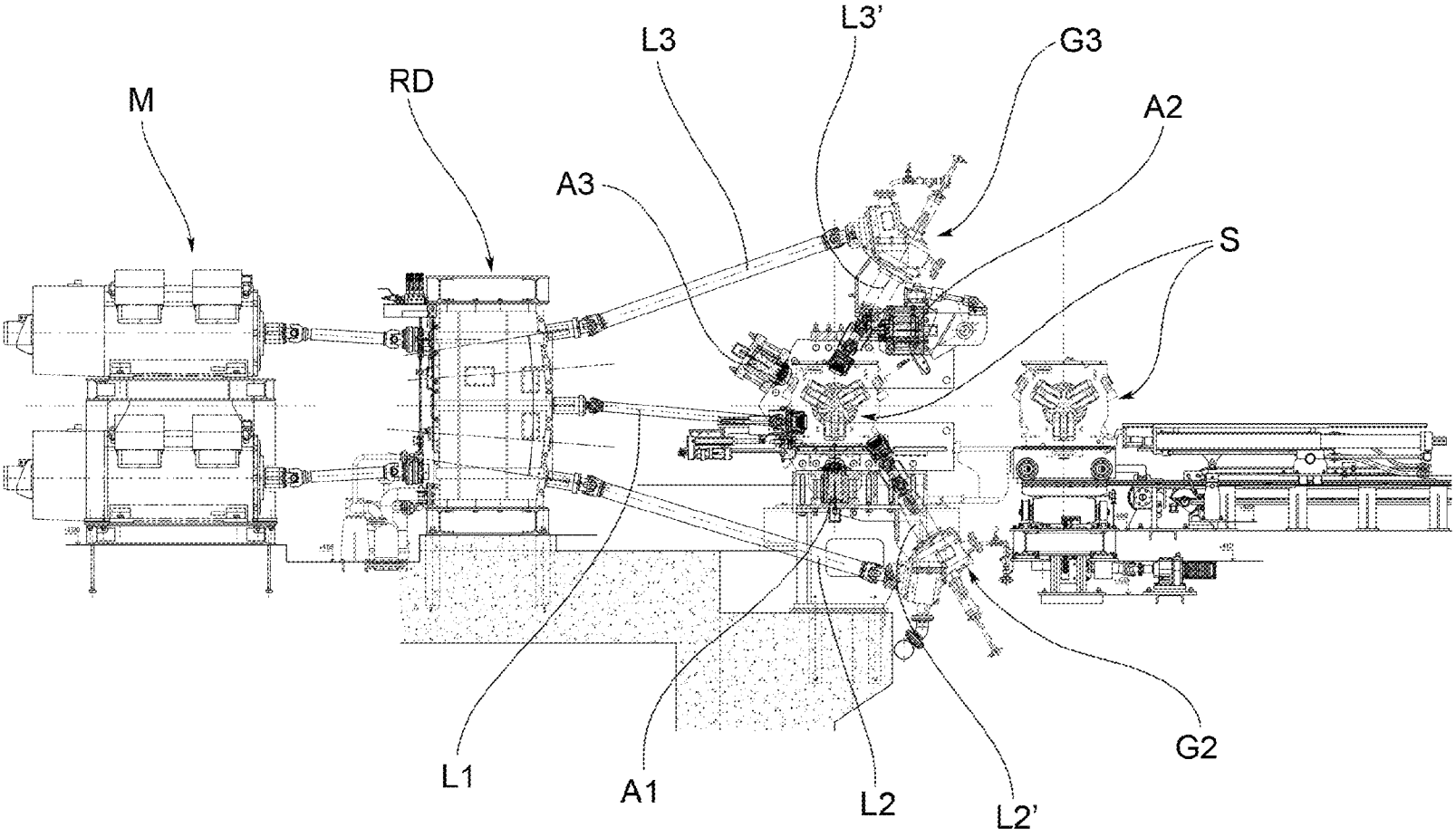
FIG. 1 shows a partial view of a first example of a rolling mill for solid elongated products of the traditional type configured to allow the extraction of all the cages from the same side of the rolling mill, the section being made at an even cage.
Figure 2:
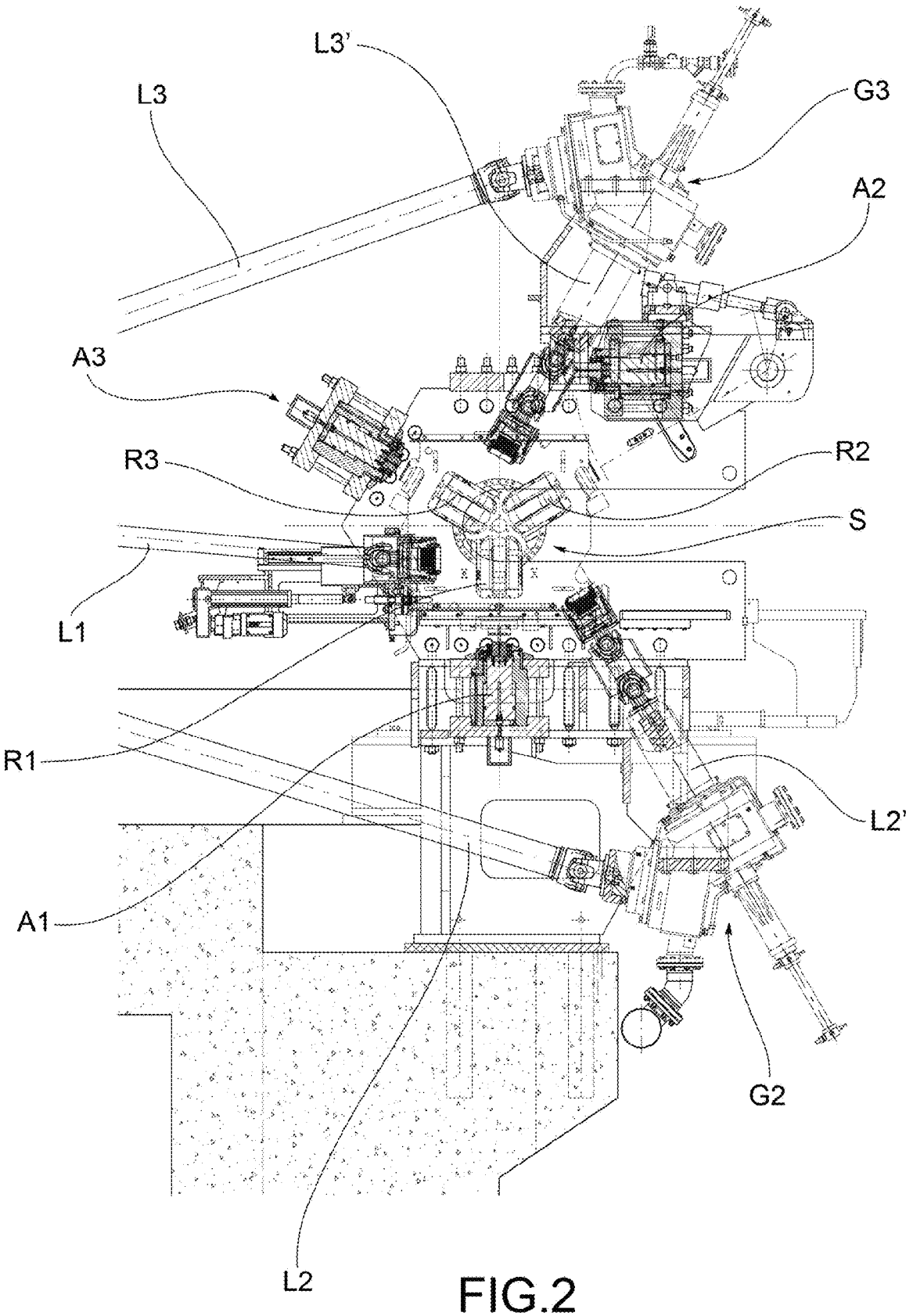
FIG. 2 shows an enlarged detail of the rolling mill of FIG. 1.
Figure 3:
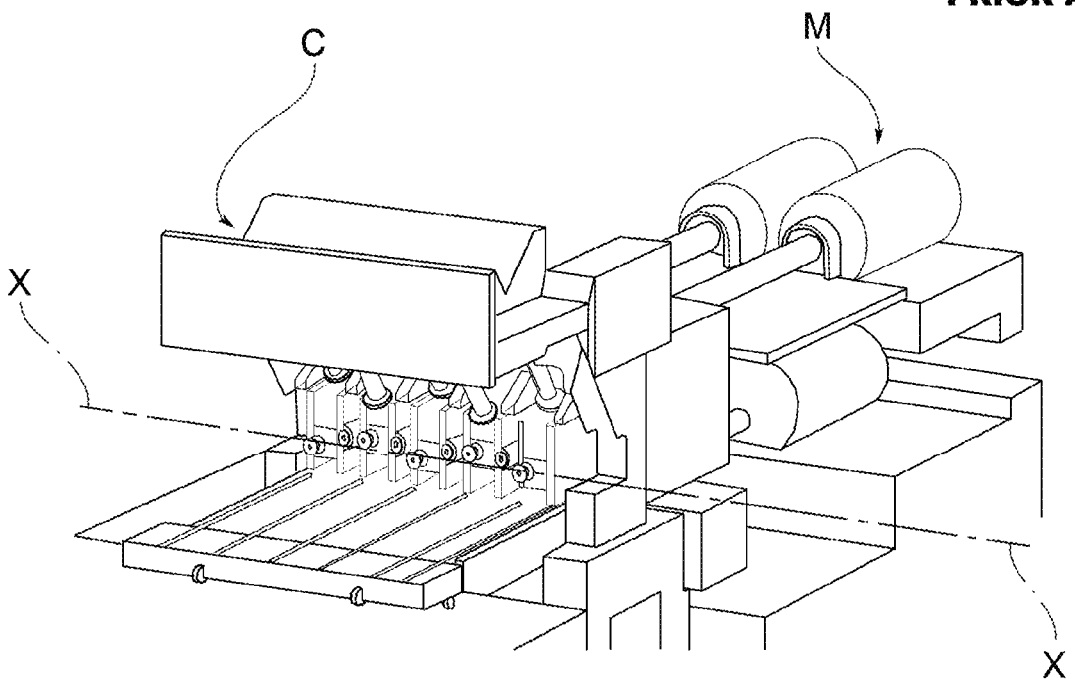
FIG.3 PRIOR ART
FIG. 3 shows a perspective view of a second example of a rolling mill for solid elongated products of the traditional type configured to allow the extraction of all the cages from the same side of the rolling mill, illustrated with an external control of the radial roll adjustment system in inoperative condition.
Figure 4:
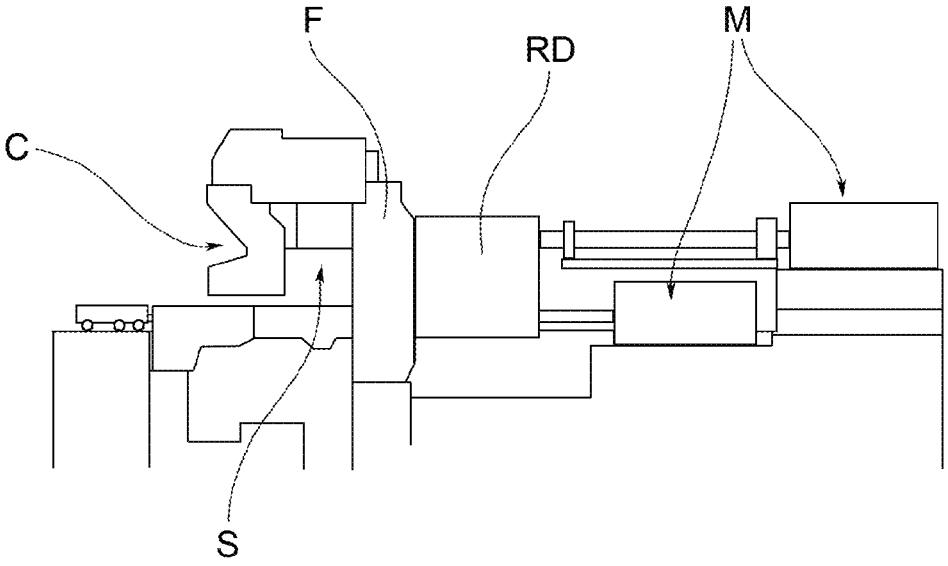
FIG. 4 shows an orthogonal side view of the rolling mill of FIG. 3, illustrated with the external control of the radial roll adjustment system in operative condition.

The present invention relates to a rolling mill for solid elongated products in the steel industry, such as bars, rods and wire rods.

Advantageously, the rolling mill according to the invention is intended in particular to carry out a finishing rolling.

The term "finishing rolling" is used herein to refer to that step in the processing of elongated products in the steel industry, such as for example bars, rods, or wire rods, in which an elongated semi-finished product is subjected to longitudinal rolling by rolls up to its final size. This processing essentially leads to a reduction in the size of the semi-finished product until its nominal value is reached.

With reference to the accompanying FIGS. 5 to 18, the reference numeral 1 indicates as a whole a rolling mill for solid elongated products of the iron and steel industry according to the invention.

Herein and in the following description and claims, reference will be made to the rolling mill 1 in use condition. Therefore, any references to a lower or upper position or to a horizontal or vertical direction should be interpreted in such condition.

The rolling mill 1 for solid elongated products defines a rolling axis X, along which the elongated products to be rolled are made to slide.

Figure 5:
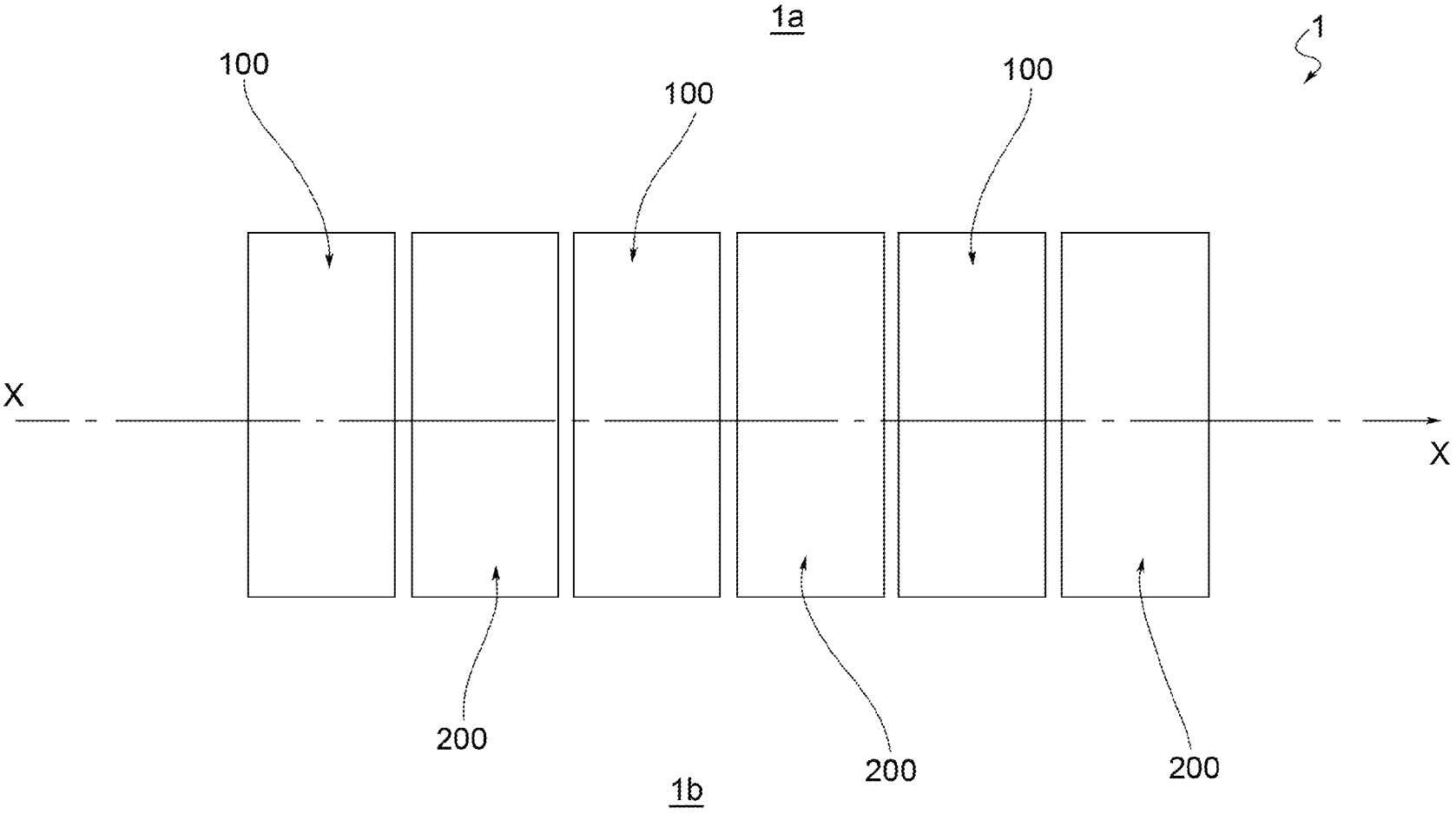
FIG. 5 shows a schematic view of the distribution of the rolling stations along the rolling axis in a rolling mill for solid elongated products according to the invention.

According to a general embodiment of the invention, the rolling mill 1 comprises a first plurality of rolling stations 100 and a second plurality of rolling stations 200 placed in series along the rolling axis X and alternated with each other between an input and an output of the rolling mill 1. This configuration of the rolling mill 1 is schematically represented in FIG. 5, where the individual stations 100 and 200 (by way of example in the total number of six) are schematically illustrated by rectangles.

Each of the aforementioned rolling stations 100 or 200 comprises:

- a load-bearing structure 110, 210, and
- a roll-holder cartridge 120, 220 which is connected in a removable manner to the load-bearing structure 110, 210 along an extraction direction Y, so that it may be extracted from the load-bearing structure itself and be replaced and/or subjected to maintenance.

Preferably, as illustrated in FIGS. 8 to 15, the load-bearing structures 110, 210 of the rolling stations are fixed to a common ground support base 2, which extends parallel to the aforementioned rolling axis X.

Advantageously, each load-bearing structure 110, 210 defines an operative housing seat 4 for a roll-holder cartridge. Such housing seat 4 is delimited at the bottom by a horizontal bottom wall 5 which acts as a support base for the roll-holder cartridge 120, 220 inside the housing seat 4.

Preferably, the load-bearing structure of each station may comprise a support structure 6 for the cartridges which constitutes an extension of the aforementioned horizontal bottom wall 5 outside the housing seat 4. This support structure 6 acts as a support base for the cartridges outside the housing seat 4.

Figure 11:
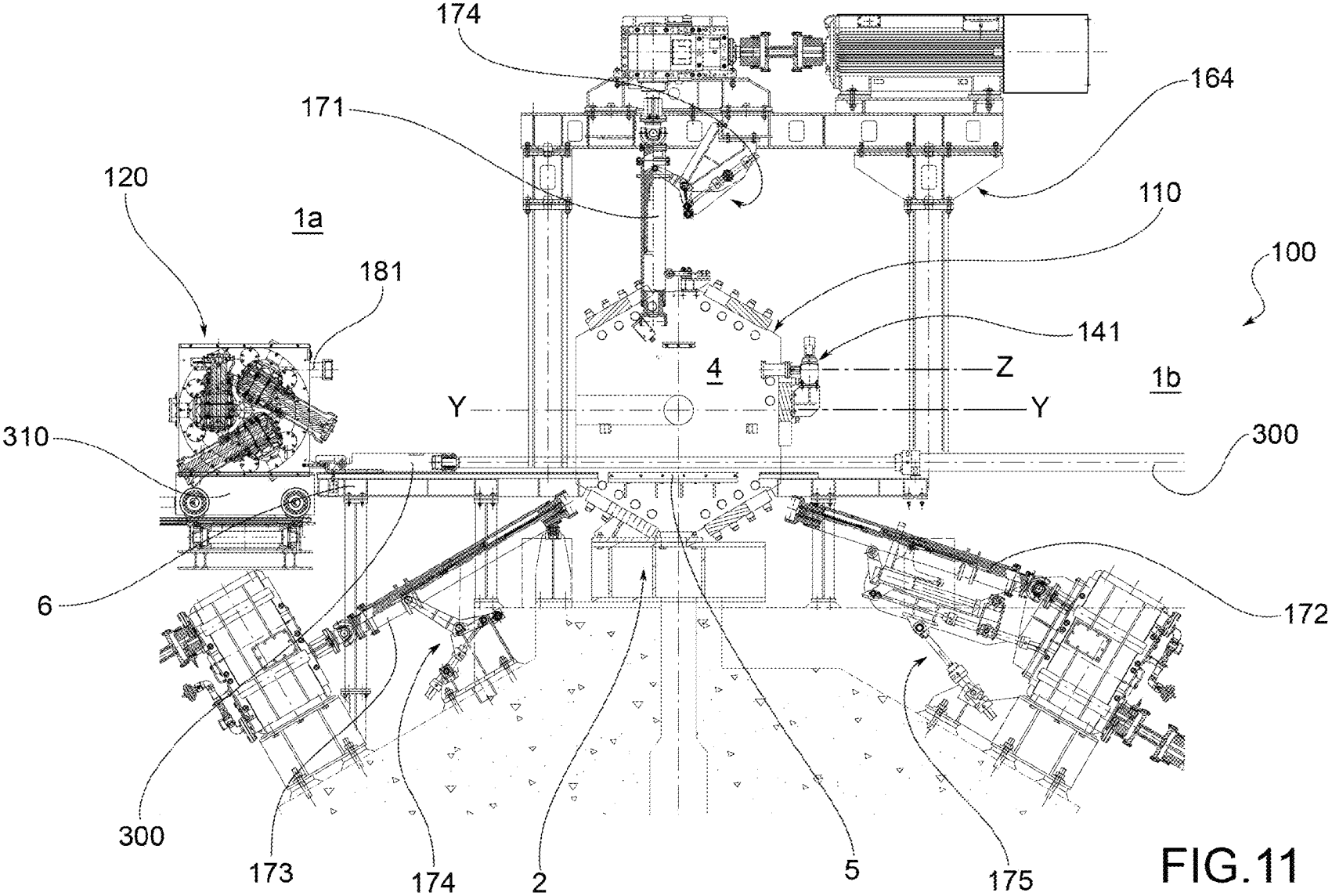
FIG. 11 shows an enlarged view of a part of the rolling mill illustrated in FIG. 10.
Figure 12:
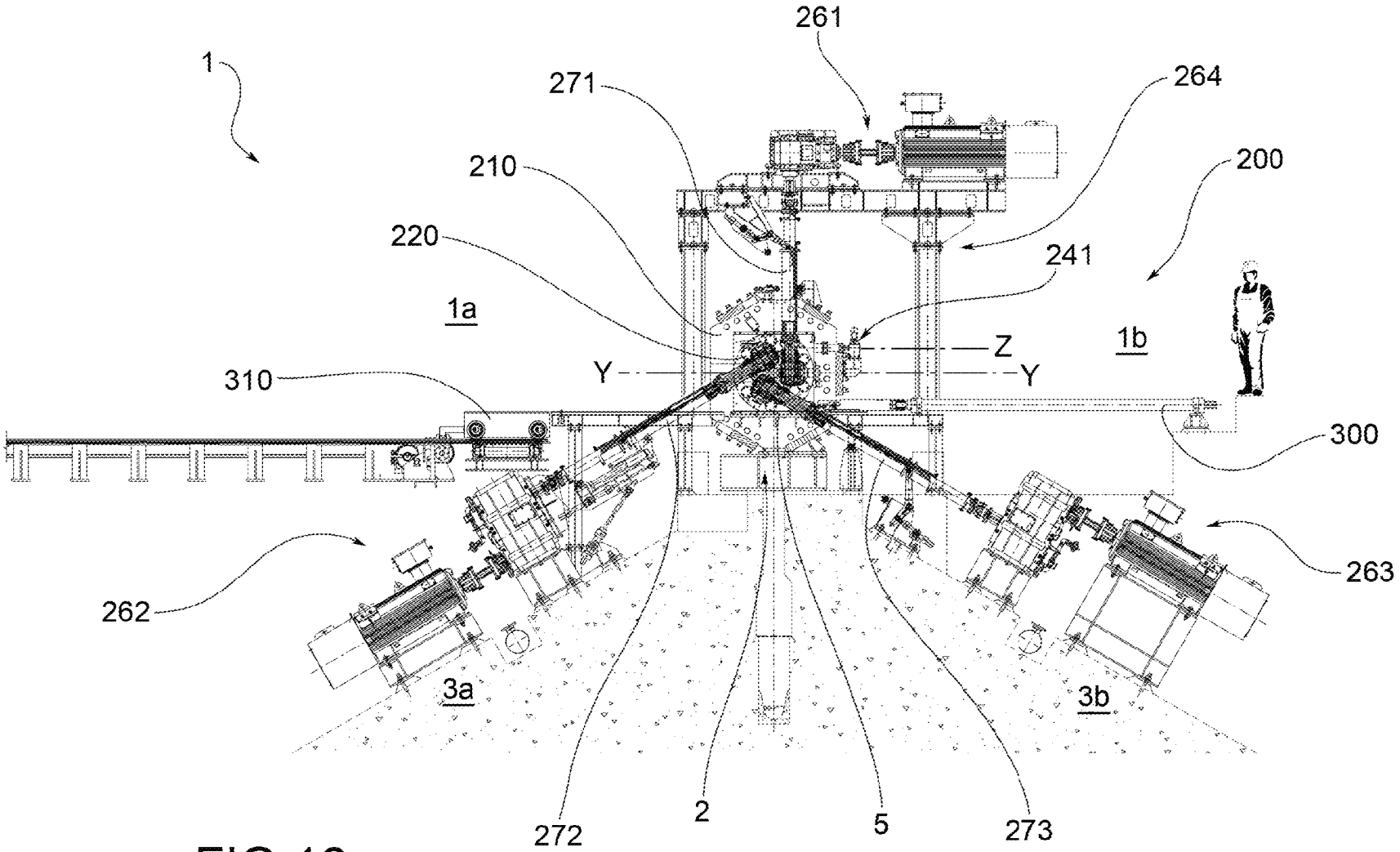
FIG. 12 shows a sectional view of a preferred embodiment of a rolling mill according to the invention, said section being made on a plane orthogonal to the rolling axis immediately upstream of the input of a station of a second plurality of stations, said station being shown with the relative roll-holder cartridge in the operative position, already operatively connected to the roll control system and to the actuation device of the roll adjustment system.
Figure 15:
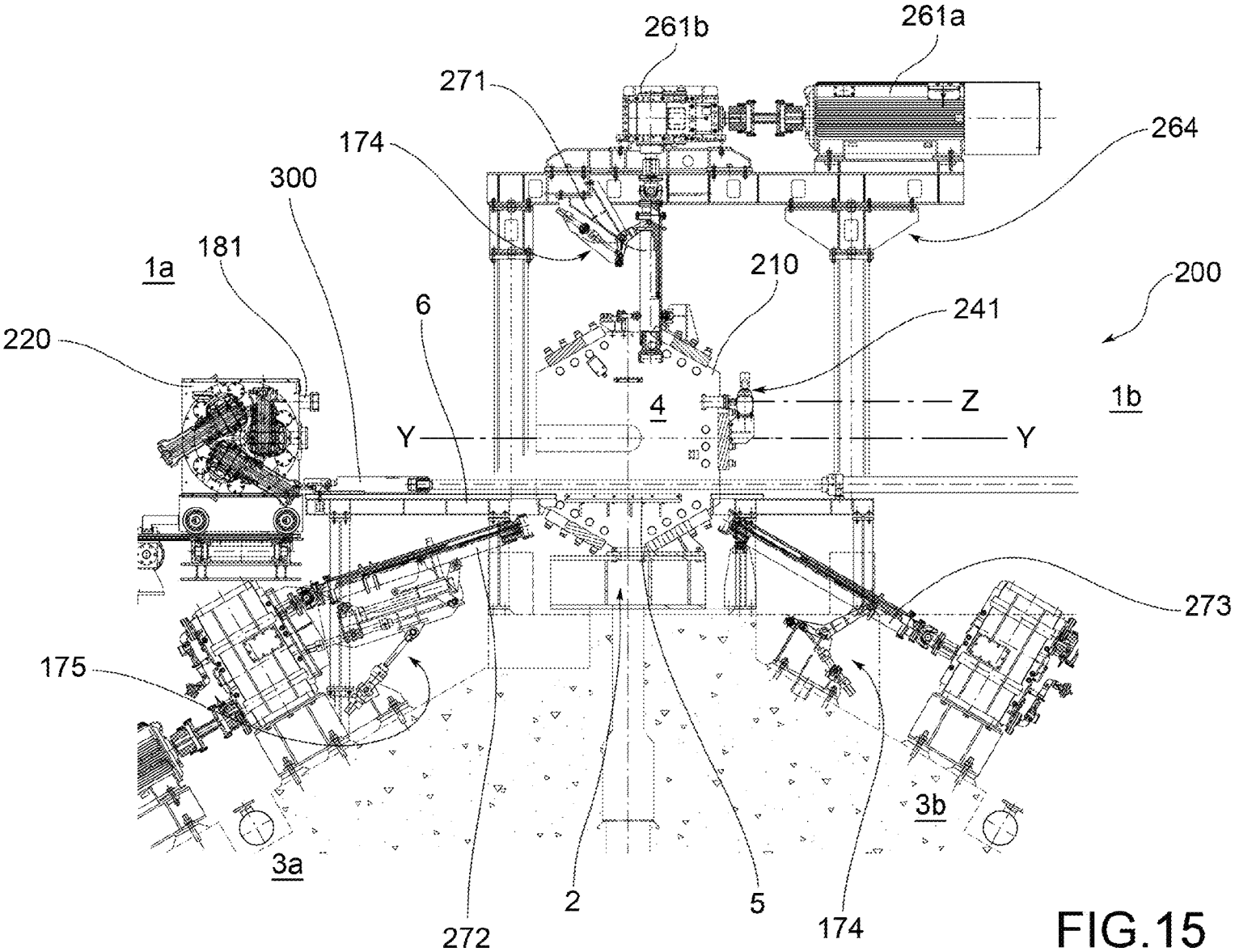
FIG. 15 shows an enlarged view of a part of the rolling mill illustrated in FIG. 14.

As illustrated for example in FIGS. 11 and 15, each roll-holder cartridge 120 or 220 comprises three rolling rolls 131, 132, 133 or 231, 232, 233, mounted on the cartridge itself so as to be radially movable with respect to the rolling axis X along respective radial axes T1, T2, T3 passing through the rolling axis.

Figure 7:
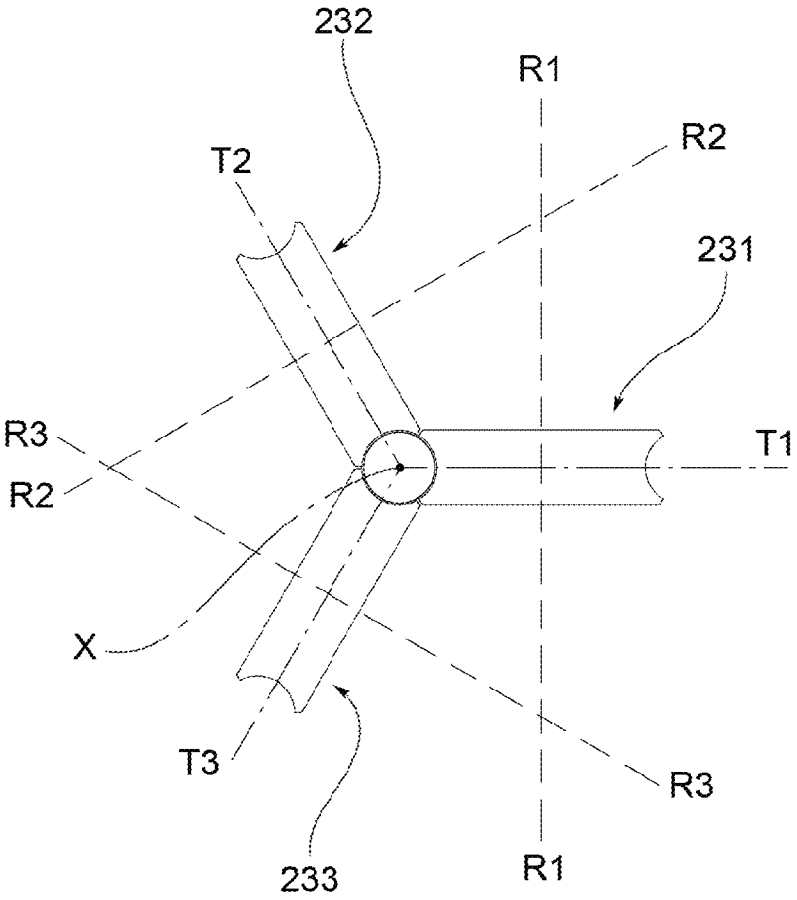
FIG. 7 shows a schematic view of the arrangement of the rolls in a rolling station of a rolling mill according to the invention, belonging to a second plurality of rolling stations.
Figure 6:
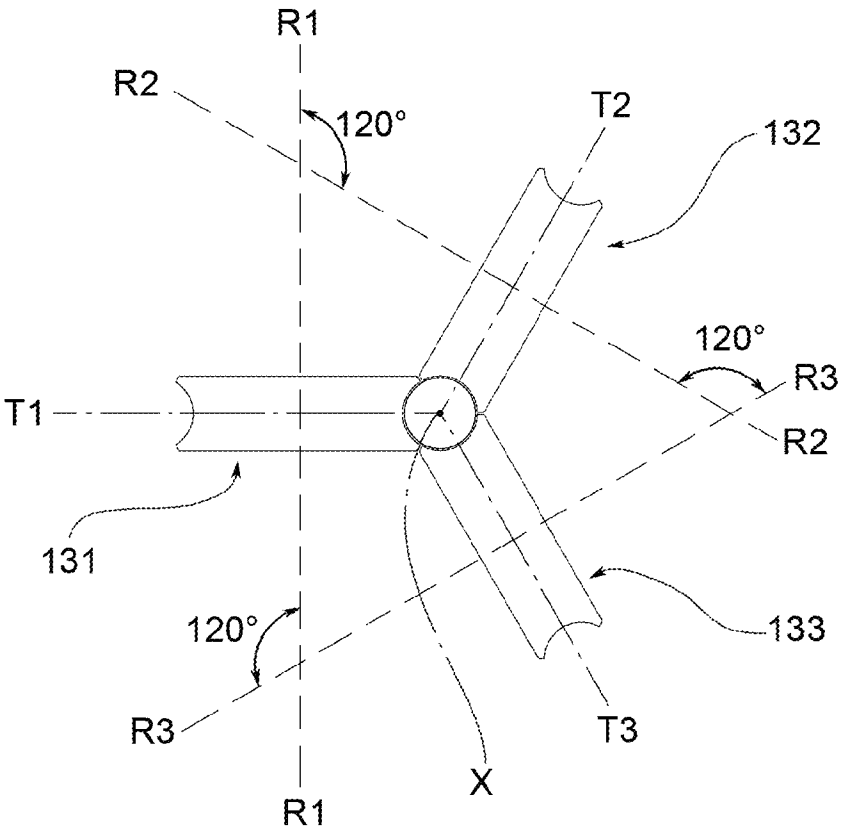
FIG. 6 shows a schematic view of the arrangement of the rolls in a rolling station of a rolling mill according to the invention, belonging to a first plurality of rolling stations.
Figure 8:
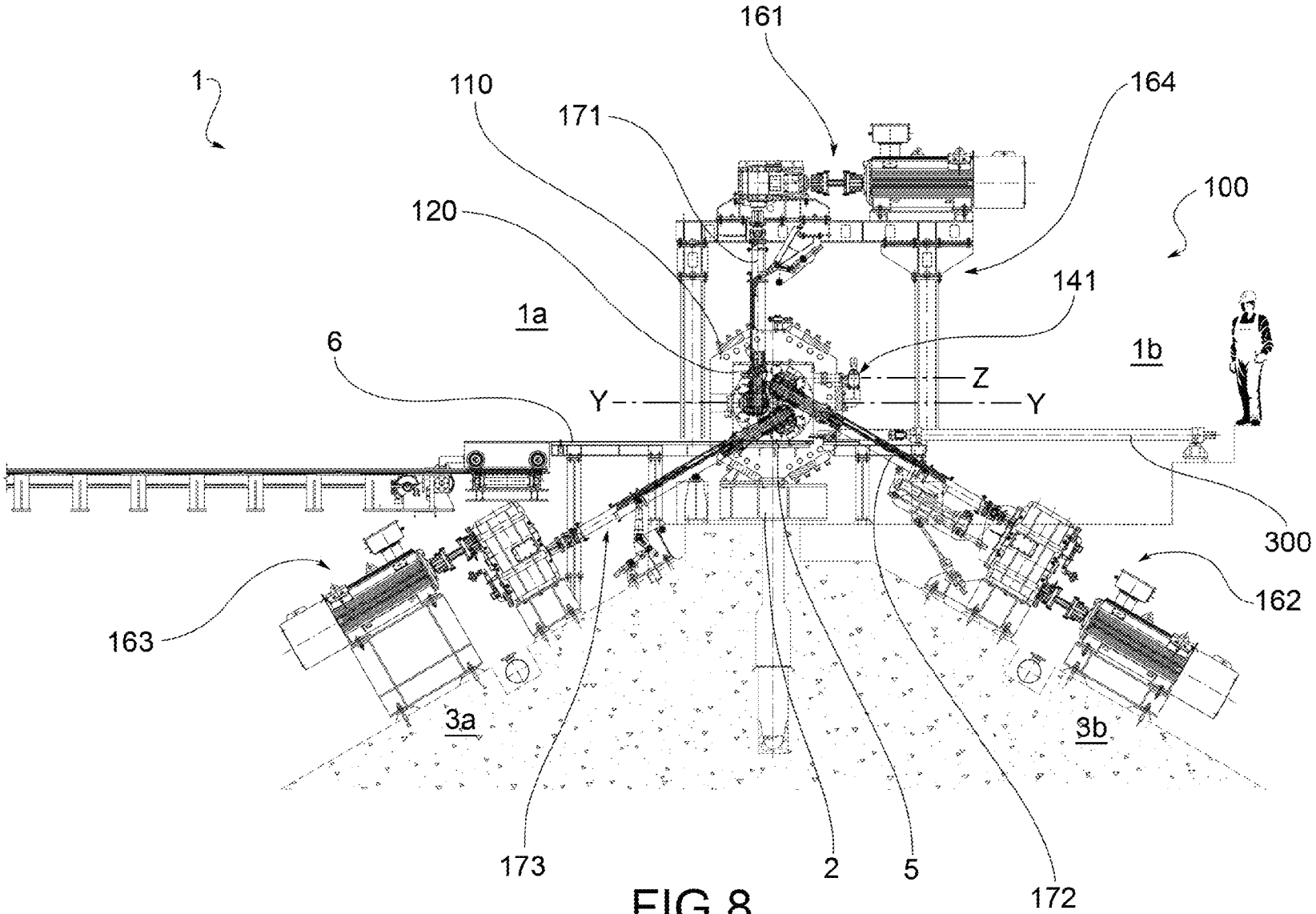
FIG. 8 shows a sectional view of a preferred embodiment of a rolling mill according to the invention, said section being made on a plane orthogonal to the rolling axis immediately upstream of the input of a station of a first plurality of stations, said station being shown with the relative roll-holder cartridge in the operative position, already operatively connected to the roll control system and to the actuation device of the roll adjustment system.

As shown schematically in detail in FIGS. 6 and 7, the three rolls 131, 132, 133 or 231, 232, 233 of each cartridge 120 or 220 are rotatable around three respective axes of rotation R1, R2, R3 set at 120° with respect to each other. One of said rolls 131,231 has its own axis of rotation R1 arranged vertically, while the other two rolls 132, 133 or 232, 233 have their respective axes of rotation R2, R3 inclined with respect to the vertical. The inclined axes of rotation R2, R3 each form an angle of 60° with respect to the vertical direction.

Each of the aforesaid rolling stations 100 or 200 comprises a system for the synchronized mechanical adjustment of all three rolls 131, 132, 133 or 231, 232, 233 mounted on board the roll-holder cartridge 120 or 220.

This mechanical adjustment system is adapted, in use, to act in a synchronized manner on said rolls so as to maintain a predefined radial distance of the rolls themselves from the rolling axis X.

The radial distance of each roll is measured along the radial axis T1, T2, T3 of each roll. By "radial axis" T1, T2, T3 of a roll it is meant the axis that is orthogonally incident the axis of rotation R1, R2, R3 of the roll and the rolling axis X.

The predefined radial distance may be adjusted according to the nominal dimensions of the elongated product to be rolled and to optimize the tolerances thereof by receiving the values measured continuously by a specially provided measuring system located downstream of the rolling mill.

By the aforementioned adjustment system, the three rolls are adjusted in a synchronized and equivalent manner in terms of variations in the radial distance. In other words, the aforesaid adjustment system is not configured to allow independent adjustment between the rolls of the same cartridge.

Each of the above rolling stations 100 or 200 further comprises a device 141, 241 for actuating the synchronized mechanical adjustment system mounted on the cartridge. Such actuation device 141, 241 is mounted on the load-bearing structure 110, 210 of the roll-holder cartridge and is suitable to engage by coupling the synchronized mechanical adjustment system along a coupling direction Z.

The synchronized mechanical adjustment system mounted on the cartridge may be of any type as long as it is suitable for the purpose and operable by a device external to the cartridge.

Figure 16:
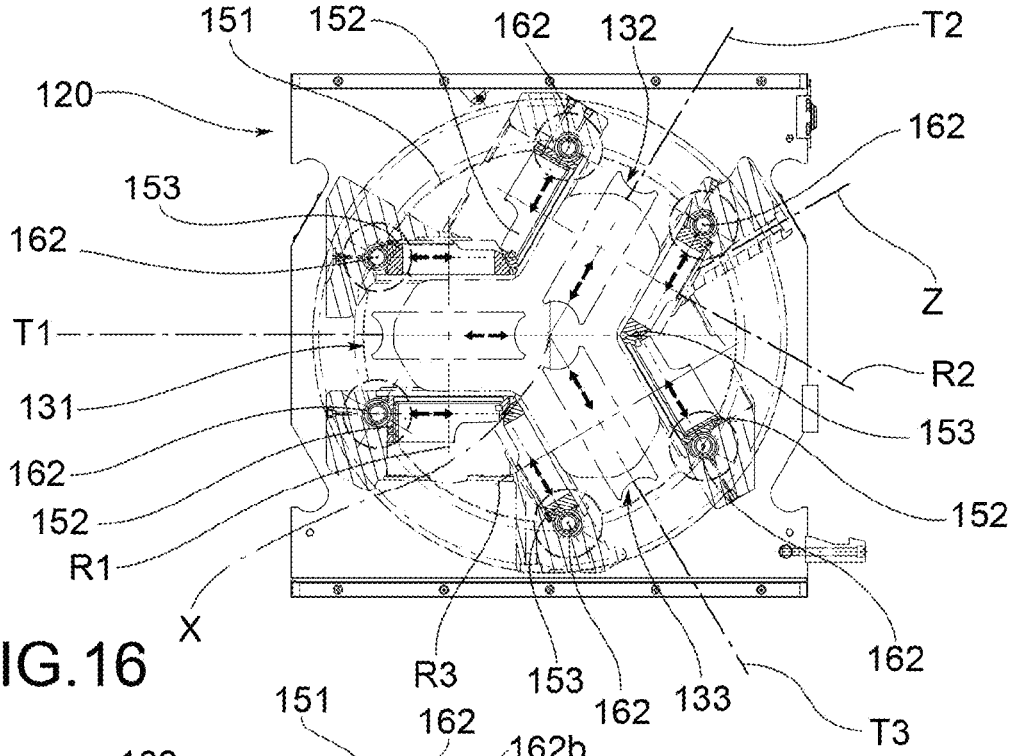
FIG. 16 shows an enlarged sectional view of a roll-holder cartridge of a rolling mill according to a preferred embodiment of the invention, provided with a system for the synchronized mechanical adjustment of the rolls.
Figure 17:
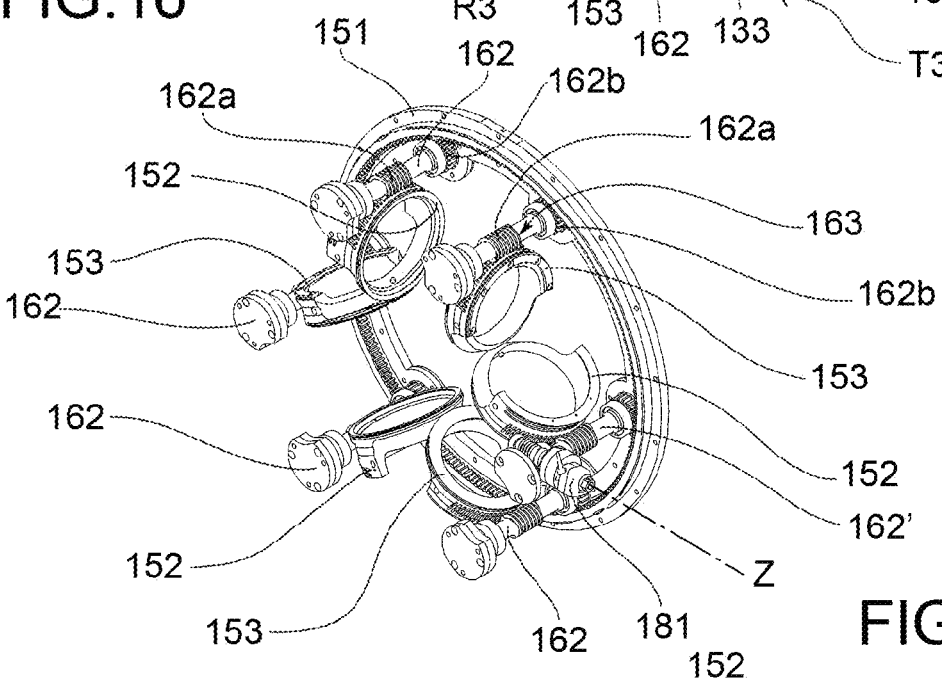
FIG. 17 shows a perspective view of the system for the synchronized mechanical adjustment of the rolls installed in the cartridge of FIG. 16.
Figure 18:
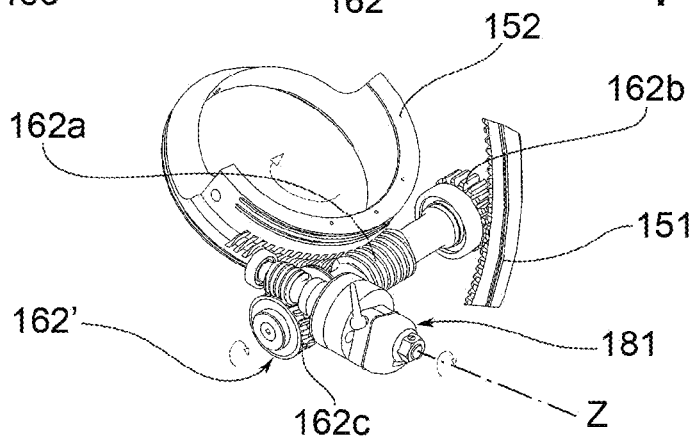
FIG. 18 shows a detail of the system for the synchronized mechanical adjustment of the rolls of FIG. 17, relative to the connection with an external device for actuating such system.

According to a preferred embodiment illustrated in FIGS. 16, 17 and 18, the aforementioned synchronized mechanical adjustment system comprises a circular toothed crown 151, which is rotationally mounted on the edge of the cartridge, coaxially to the rolling axis X. On the side of the circular crown 151 the three rolls of the cartridge are positioned, with respective axes of rotation parallel to the plane of the circular crown 151. The adjustment system comprises for each roll a pair of toothed circular bushes 152, 153, arranged with the respective roll interposed between them. The two bushes are coaxial to each other and eccentric with respect to the axis of rotation R1, R2, R3 of the roll. In this way, a rotation of the two bushes about their own axis corresponds to a translation of the roll parallel to its own radial axis T1, T2, T3.

The adjustment system also comprises, for each bush 152, 153 an element 162, for kinematic connection between the bush and the circular crown 151. More in detail, such element 162 consists of a rod comprising a first portion 162*a* consisting of a worm screw (engaged on the toothed bush) and a second portion 162*b* consisting of a toothed wheel (engaged on the circular crown 151).

One of the kinematic connection elements (numbered as 162' and hereinafter referred to as the "main kinematic connection element") further comprises a third portion 162*c*, consisting of a further toothed wheel. Said third portion 162*c* is kinematically coupled to a coupling body 181, engageable by fitting by the aforementioned actuation device 141, 241 disposed externally to the cartridge. The engagement between the coupling body 181 and the actuation device 141, 241 takes place along a predefined coupling direction Z. Advantageously, the engagement between the coupling body 181 and the actuation device 141, 241 may be obtained in any way suitable for the purpose. For example, in the embodiment illustrated in FIGS. 17-18, the engagement is obtained by a coupling having a hexagonal shape. Alternatively, as illustrated for example in FIGS. 9, 11, 13 and 15, the engagement is obtained by a coupling between toothed portions.

Operationally, during the adjustment step, the actuation device 141, 241 imposes on the main kinematic connection element 162' a rotation on its own axis by the coupling body 181. This rotation causes a rotation of the bush 152 directly connected to it, but also at the same time an equivalent rotation of the other bushes by virtue of the kinematic connection ensured by the circular toothed crown 151 and by the other rods 162. The mechanism described above thus ensures synchronized adjustment of all three rolls of a cartridge.

Each of the aforementioned rolling stations 100 or 200 also comprises three gear motor groups 161, 163 or 261, 262, 263 which are connected to the rolls by single extensions 171, 172, 173 or 271, 272, 273 so as to provide the rolls themselves with the rotation and the torque necessary to force the product to advance along the rolling axis X. In other words, as illustrated in the accompanying figures, each individual rolling station 100 or 200 is provided with three single extensions, one for each gear motor group and relative roll.

In each rolling station, the set of the three gear motor groups and the relative single extensions constitute a control system of the rolls with single controls.

Figure 9:
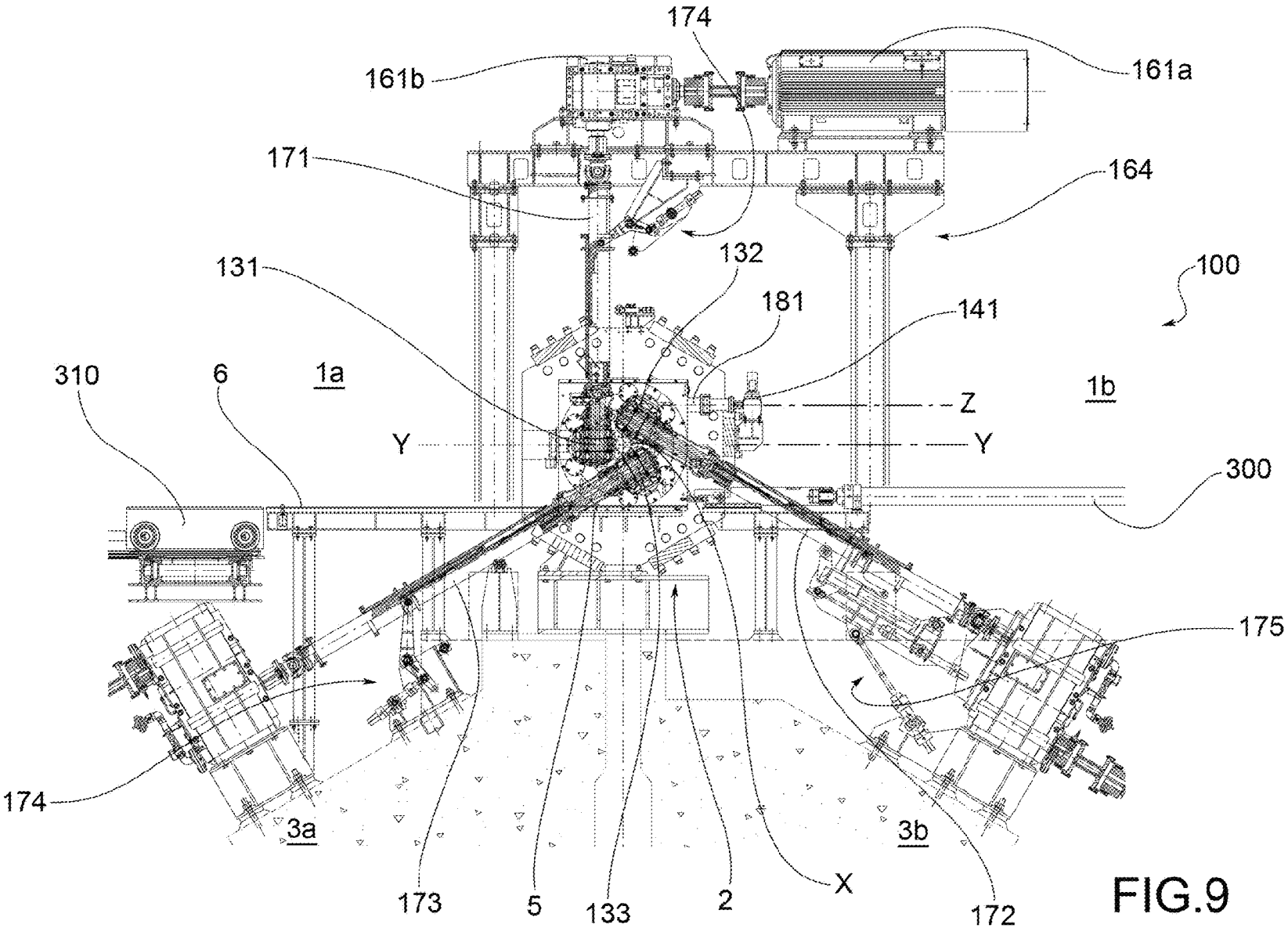
FIG. 9 shows an enlarged view of a part of the rolling mill illustrated in FIG. 8.
Figure 13:
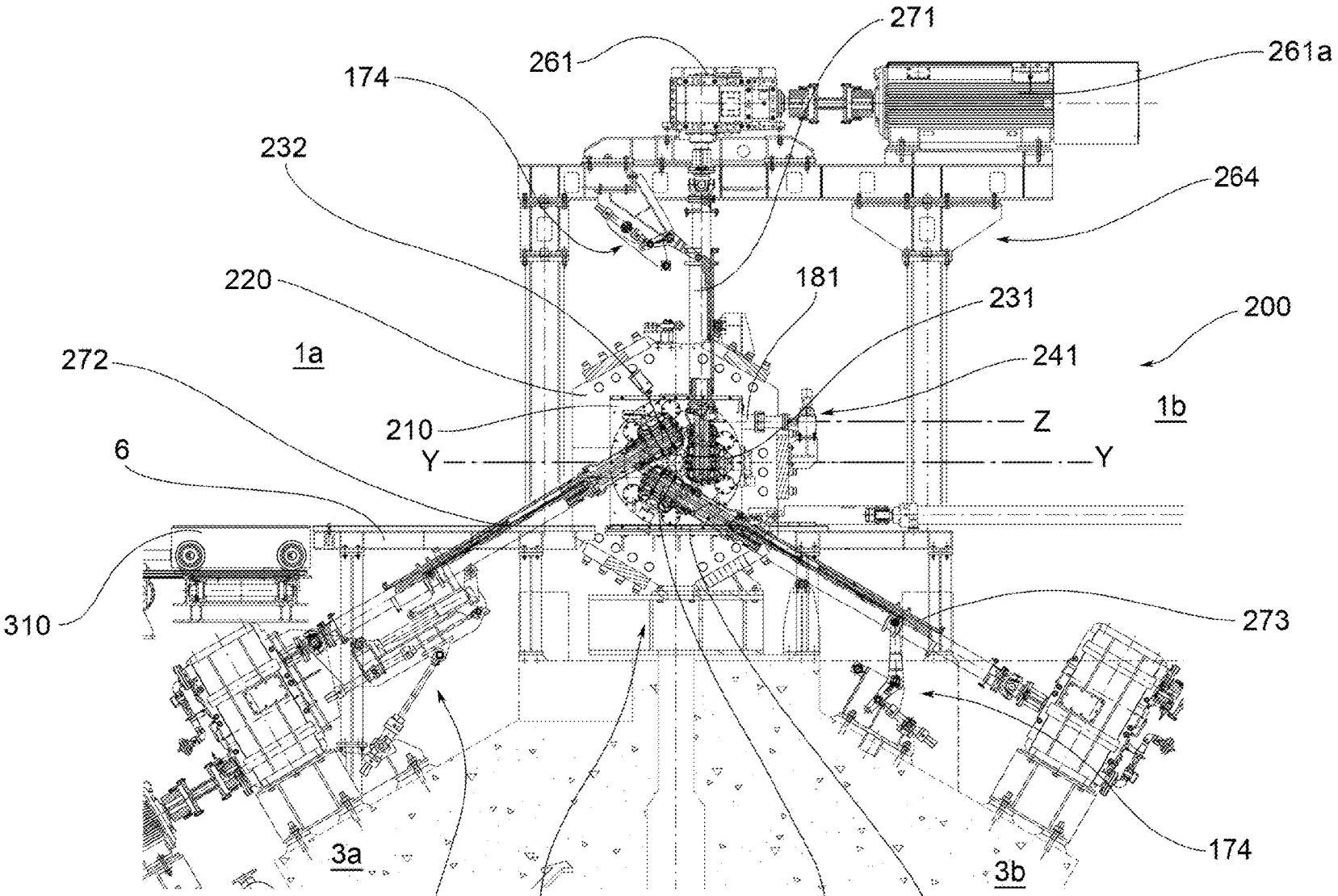
FIG. 13 shows an enlarged view of a part of the rolling mill illustrated in FIG. 12.
Figure 14:
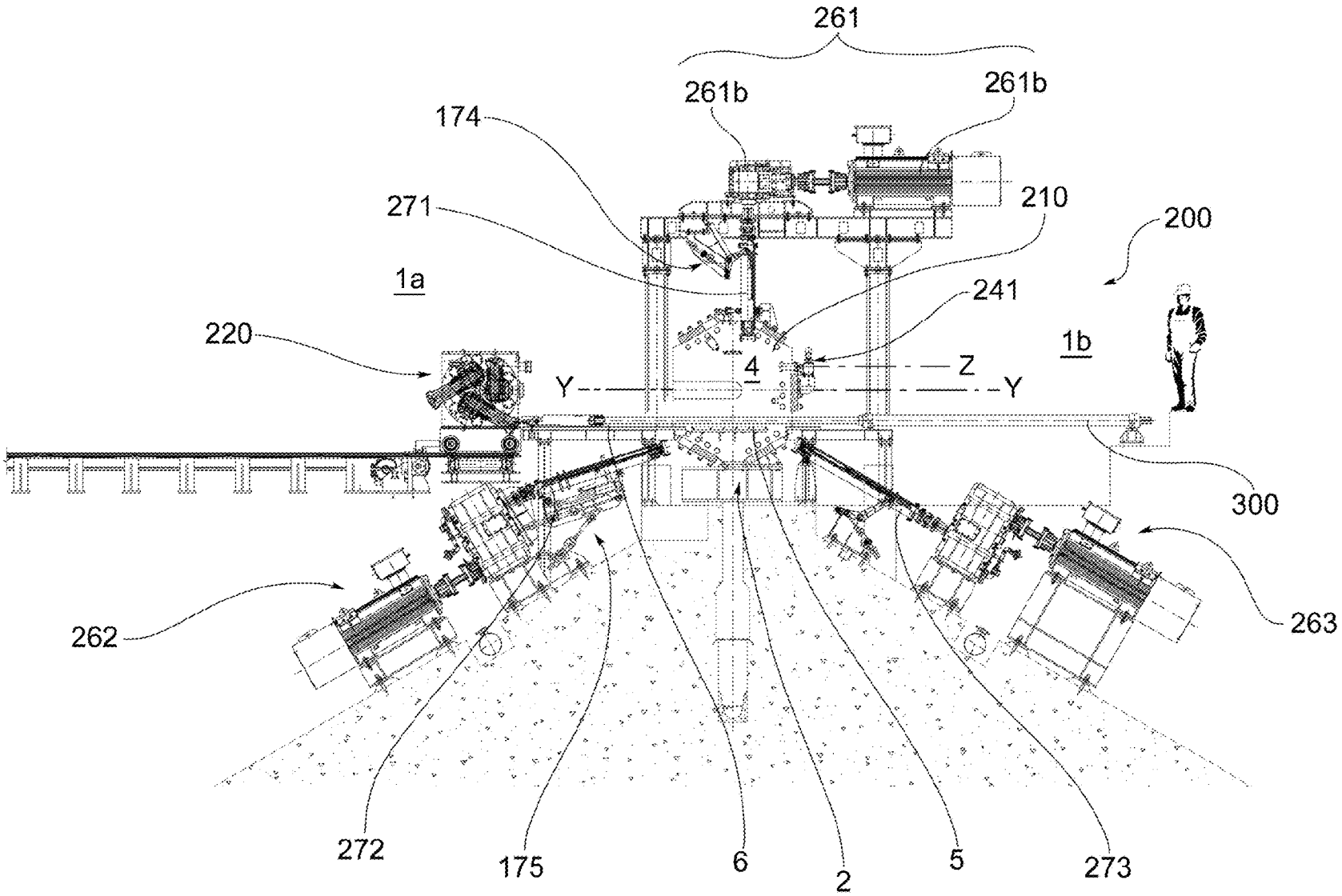
FIG. 14 shows the same sectional view of the rolling station of FIG. 12, wherein the station is shown with the relative roll-holder cartridge in the extracted position, operatively disconnected from the control system and from the actuation device of the roll adjustment system.

As may be seen by comparing, for example, FIGS. 9 and 13, the position of the rolls 231, 232, 233 of said second plurality of stations 200 is rotated by 60° about the rolling axis X with respect to the position of the rolls of said first plurality of stations 100.

By virtue of such angular arrangement of the rolls rotated between the stations 100 of the first plurality and the stations 200 of the second plurality, it is possible to roll in a uniform manner the product which slides along the rolling axis. In a given station, the groove bottom of the respective rolls acts, in fact, at the portion of the product which in the previous station was not affected by the action of the rolls.

Furthermore, due to the aforementioned angular arrangement of the rolls rotated between two consecutive stations, the rolls 131 with a vertical axis of the first plurality of stations 100 are arranged on a first side 1*a* of the rolling mill 1, while the rolls 231 with a vertical axis of the second plurality of stations 200 are arranged on a second side 1*b* of the rolling mill 1, opposite the first with respect to the rolling axis X.

The arrangement of the rolls in the first plurality of stations 100 and in the second plurality of stations 200 is represented in a simplified manner in FIGS. 6 and 7, respectively. It may be observed that the rolls 131, 231 with vertical axis have their relative radial axes T1 horizontal, while the inclined rolls 132, 133 and 232, 233 have their respective radial axes T2 and T3 inclined by 30° with respect to the vertical direction. With respect to a horizontal plane passing through the rolling axis X, it is also possible to identify an upper inclined roll 132, 232 and a lower inclined roll 133, 233.

With the expression "roll disposed on one side of the rolling mill" it is meant that said roll extends radially from the rolling axis towards the outside of the rolling mill in a horizontal direction on such side.

According to the invention, all the rolling stations 100, 200 of the rolling mill 1 are configured to allow the lateral extraction of the respective roll-holder cartridges 120 and 220 from the same side of the rolling mill 1, identified hereafter as "cartridge extraction side."

Such cartridge extraction side (which is the same for all rolling stations 100 and 200) may correspond to:

- the aforementioned said first side 1*a*, i.e. the side of the rolling mill 1 on which the rolls 131 with vertical axis of the first plurality of stations 100 are arranged; or
- the aforementioned second side 1*b*, i.e. the side of the rolling mill 1 opposite the first, on which the rolls 231 with vertical axis of the second plurality of stations 200 are arranged.

Preferably, as illustrated in the accompanying figures, the cartridges 120, 220 are extracted from the relative stations 100, 200 following an extraction path along the aforementioned extraction direction Y which lies on a horizontal plane defined by the aforementioned horizontal bottom wall 5 and by the support structure 6 outside the housing seat 4.

According to the invention, as illustrated in FIGS. 8 to 15, all the rolling stations 100, 200 may have the respective devices 141, 241 for operating the synchronized mechanical adjustment system fixedly mounted on the load-bearing structure 110, 210 of the roll-holder cartridge. Such configuration may be adopted if these devices 141, 241 are positioned on the side of the rolling mill 1*b* opposite the cartridge extraction side and have their respective coupling direction Z parallel to the extraction direction Y.

By virtue of this configuration, the following occurs:

- the actuation devices 141, 241 are arranged outside the cartridge extraction path and never constitute a hindrance element; and moreover
- the extraction/insertion movement of the cartridges in the respective stations along the direction Y is compatible with the movement required for the engagement and disengagement of the actuation devices 141, 241 in the cartridges.

Operationally, by virtue of this configuration, the actuation device 141, 241 may then automatically fit on the cartridge when the cartridge is inserted in the rolling station, without requiring any movement of the actuation device. In an equally automatic manner, i.e. without requiring any movement of the actuation device, the actuation device 141, 241 may also be disengaged from the cartridge when the cartridge is extracted from the rolling station.

This configuration significantly simplifies the preparation of a free extraction path for the cartridges on the same side of the mill. In fact, in this case, as will be discussed again below, only a movement of the single extensions 171, 172, 173 or 271, 272, 273 is required.

Alternatively, always according to the invention, all the rolling stations 100, 200 may have the respective devices 141, 241 for operating the synchronized mechanical adjustment system mounted in a movable manner on the load-bearing structure 110, 210 of the roll-holder cartridge. This configuration is adopted if these devices 141, 241 are positioned in such a way as to have the respective coupling direction Z incident to the extraction direction Y.

In this case, in fact, the extraction/insertion movement of the cartridges in the respective stations along the direction Y is not compatible with the movement required for the engagement and disengagement of the actuation devices 141, 241 in the cartridges and it is therefore necessary to move these devices 141, 241 at least to disengage the respective synchronized mechanical adjustment systems before the cartridges are extracted.

If these devices 141, 241 are not arranged along the cartridge extraction path, they do not constitute an obstacle element. Their movement may therefore have a limited width, sufficient to allow disengagement from the respective adjustment systems and from the cartridges.

If such devices 141, 241 are instead positioned along the cartridge extraction path, they constitute an obstacle element. Their handling must therefore have a greater width, being aimed at completely freeing the extraction path for the cartridges.

Embodiments may be provided in which the two different solutions described above are both adopted, in the sense that:

- some rolling stations adopt the first solution (i.e. actuation devices fixedly mounted on the side of the rolling mill opposite to the cartridge extraction side, with coupling direction Z parallel to the extraction direction Y); and
- the remaining rolling stations adopt the second solution (i.e. actuation devices mounted in a movable manner, with the coupling direction Z incident to the extraction direction Y).

According to the preferred embodiment illustrated in the accompanying figures, all the rolling stations are configured according to the first solution, i.e. with the actuation devices fixedly mounted on the side of the rolling mill opposite to the cartridge extraction side and having a coupling direction Z parallel to the extraction direction Y. In particular, the extraction direction Y and the coupling direction Z are parallel and horizontal.

Furthermore, always according to the invention, the single extensions 171, 172, 173 and 271, 272, 273 of all the rolling stations 100, 200 may be moved with respect to the load-bearing structures 110, 210 of the respective stations so as to be able to disengage the respective rolls 131, 132, 133 and 231, 232, 233 and possibly free the extraction path for the cartridges.

A rolling mill 1 for solid elongated products having the features described above combines the possibility of extracting all the cartridges from the same side with a simplified roll control system which does not require special angular gearboxes.

As already highlighted, the control system of the rolls of each single station consists of three gear motor groups 161, 163 or 261, 262, 263 connected to the rolls by single extensions 171, 172, 173 or 271, 272, 273. The control system therefore provides a dedicated gear motor group for each roll. By virtue of this, it is possible to spatially arrange each gear motor group according to the position of the respective roll, with a kinematic connection between the group and the roll defined by a single extension. This avoids the need to adopt kinematic connection solutions by double extensions connected to each other by special angular gearboxes, solutions which are unavoidable in the case of rolling mills with a single motor control system for all the rolls of a cartridge.

By virtue of this configuration of the control system and the spatial distribution of the rolls which in each station provides a roll with a vertical axis of rotation, in each station it is also possible to arrange one of the three extensions vertically and the remaining two extensions (dedicated to the two inclined rolls) on two axes substantially at 60° with respect to the vertical. In other words, in all the rolling stations it is possible to avoid in a simple way having extensions (with the relative gear motor groups) directly below the rolling stations, making them more easily accessible for maintenance activities.

The configuration of the control system also avoids the positioning of gearboxes directly below the rolling stations. This avoids at the root the problems related to the infiltration of water into the lubrication system through the gearboxes.

Preferably, as illustrated in the accompanying figures, the single extensions 171, 172, 173 and 271, 272, 273 are arranged so as to be substantially aligned in an axial direction with the axes of rotation R1, R2, R3 of the respective rolls 131, 132, 133 and 231, 232, 233, when operationally connected to them.

The expression "extension with axis aligned with the axis of rotation of the respective roll" means the average alignment position that occurs during the transmission of motion to the rolls, net of the radial adjustments of the rolls according to the nominal dimensions of the product and tolerance optimizations.

In this way, preferably, in each rolling station the extension 171, 271 dedicated to the roll with vertical axis is arranged vertically, while the remaining two extensions 172, 173 and 272, 273 (dedicated to the two inclined rolls) are arranged on two axes substantially at 60° with respect to the vertical.

According to the embodiment illustrated in the accompanying figures, the extensions 171, 271 associated with the rolls 131, 231 with vertical axis are axially arranged vertically and are associated with the respective gear motor groups 161, 261, each of which comprises a motor 161*a*, 261*a* horizontally arranged and an angular gearbox 161*b*, 261*b* in which the input shaft and the output shaft form an angle of 90°. In particular, each of such gear motor groups 161, 261 is supported above the respective rolling station 100, 200 by a scaffold 164, 264.

According to an alternative embodiment not shown in the accompanying figures, the extensions 171, 271 associated with the rolls 131, 231 with vertical axis are axially arranged vertically and may be associated with the respective gear motor groups 161, 261, each of which comprises a vertically arranged motor and a gearbox with parallel axes of the input and output shafts. In particular, each of such gear motor groups 161, 261 is supported above the respective rolling station 100, 200 by a scaffold 164, 264.

Preferably, the extensions 172, 173 and 272, 273 associated with the rolls 132, 133 and 232, 233 with inclined axes are associated with the respective gear motor groups 163 and 262, 263 each of which comprises a motor and a gearbox with parallel axes of the input and output shafts. In particular, as illustrated in the accompanying figures, each of such gear motor groups 163 and 262, 263 is arranged on a base 3*a* or 3*b* (foundations) defined by an inclined plane (preferably at 60° with respect to the vertical), which develops alongside the common ground support base 2, on one of the two sides 1*a* or 1*b* of the rolling mill parallel to the rolling axis X. Alternatively, the base 3*a* or 3*b* (foundations) may define a horizontal plane and the gear motor group be installed on the base with the necessary inclination.

Preferably, the gear motor groups 161, 163 and 261, 262, 263 of all the rolling stations are fixedly mounted on the respective support bases. In this case (completely preferred), as will be clarified later in the description, the movement to disengage the extensions from the rolls (and possibly free the extraction path of the cartridges) is obtained by moving only the extensions, without therefore affecting the gear motor groups. This simplifies the system significantly.

As already highlighted above, the single extensions of all the rolling stations 100, 200 may be moved with respect to the load-bearing structures 110, 210 to disengage the respective rolls 131, 132, 133 and 231, 232, 233 and possibly free the extraction path for the cartridges.

Preferably, the extensions 171, 172, 173 and 271, 272, 273 of all the rolling stations 100, 200 may be moved with respect to the load-bearing structures of the respective rolling stations by at least one translation movement along their axis.

According to the preferred embodiment illustrated in the accompanying figures, the single extensions 171, 172, 173 and 271, 272, 273 have a telescopic structure. In this case, the aforementioned translation movement of the extensions along their axis (functional to disengage the respective rolls and possibly free the extraction path for the cartridges) may be obtained with an axial sliding movement between two or more different portions of the telescopic structure of the single extension.

According to an embodiment not shown in the accompanying figures, the single extensions 171, 172, 173 and 271, 272, 273 may be configured so as to be able to slide along the gearbox shaft of the respective gear motor group. This sliding movement causes a translation of the extension along its own axis. Such axial sliding allows the extension to uncouple from the hub of the respective roll and, if necessary, to free the extraction path for the relative cartridge.

The adoption of telescopic extensions may be provided as an alternative or in combination with the adoption of extensions sliding along the shaft of the respective gear motor group.

According to the preferred embodiment illustrated in the accompanying figures, in all the rolling stations 100, 200 at least one of the single extensions 172, 272 may be subjected to a roto-translation movement to disengage the respective roll 132, 232 so as to free the relative cartridge for extraction and possibly free the extraction path for the cartridge itself.

From an operational point of view, being the width of the translation movement equal, compared to a simple translation, a roto-translation allows an extension to be moved away more markedly from the relative cartridge, thus making it possible that, without an excessive translation stroke, the extraction path of the cartridge from the rolling mill may be freed.

This solution may be adopted for all the extensions of a rolling station. However, this solution is preferably adopted only for the extension 172, 272 operatively associated with the upper inclined roll 132, 232. In fact, as may be observed in particular in FIGS. 9 and 13, the extensions which most invade the operative housing seat 4 are the extensions 172, 272 associated with the upper inclined rolls 132, 232.

It should be noted that the solution with roto-translational movement is preferably to be adopted for the extensions 272 associated with the upper inclined rolls in the rolling stations which have the vertical rolls arranged on the side opposite to the cartridge extraction side. In fact, in these stations the extensions of the upper inclined rolls are located along the cartridge extraction path and for this reason their complete movement is important.

Differently, the extensions 173, 273 associated with the lower inclined rolls 133, 233 and the extensions 171, 271 associated with the vertical rolls 131, 231 invade the respective operative housing seats 4 to a much lesser extent, thus requiring movements of a more limited width, which may be carried out with simple axial translations.

Preferably, each rolling station 100, 200 with movable actuator is provided with means 174, 175 for moving the respective extensions. Such movement means 174, 175 may be any, provided they are suitable for the purpose.

In the embodiment illustrated in the accompanying FIGS. 8 to 15, these movement means may consist of a simple lever mechanism 174 actuated by a hydropneumatic cylinder piston to generate simple translation movements (in particular for the extensions 171, 173, 271, 273). These movement means may instead consist of a device 175 for the axial translation of the extension, mounted on a rotatable base, to generate roto-translation movements (for the extensions 172, 272)

Advantageously, each rolling station 100, 200 may comprise a device 300 for moving the respective cartridge along the cartridge extraction path.

In particular, this device 300 may be suitable both to move the cartridge out of the operative housing seat 4, and to bring it inside said housing seat.

Preferably, said movement device 300 is placed on the side 1*b* of the rolling mill 1 opposite the cartridge extraction side 1*a*.

More in detail, during the cartridge extraction step the device 300 exerts a pushing action on the cartridge, while during the positioning of the cartridge inside the housing seat 4 the device 300 exerts a pulling action on the cartridge.

By virtue of this configuration, the movement device 300 is never positioned in the space for maneuvering and changing the cartridge. This allows always having free space for cartridge maneuvering and change, allowing a direct connection from the rolling mill to the cartridge maintenance workshop. Such configuration also simplifies the structure of the movement device. In particular, no particular constructive measures are required to prevent the movement device from hindering the movements of the cartridge.

According to a preferred embodiment illustrated in the accompanying figures, the aforementioned movement device 300 consists of at least one hydropneumatic cylinder.

More in detail, the hydropneumatic cylinder 300 is arranged in such a way as to act in an axial direction parallel to the aforementioned horizontal bottom wall 5, which acts as a support base for the roll-holder cartridge 120, 220 inside the housing seat 4, and to the aforementioned support structure 6 for the cartridges which constitutes an extension of the bottom horizontal wall 5 outside the housing seat 4. Preferably, the hydropneumatic cylinder is arranged in proximity to the sliding plane of the cartridge, so as to exert its action at the base portion of the cartridge itself.

Operationally, once the three extensions have been disengaged from the rolls of the respective cartridge and a free path has been prepared from the housing seat towards the outside on the cartridge extraction side 1*a* (possibly moving the actuation devices 141,241), the movement device is operated. The cartridge is then pushed by the device 300 from the housing seat 4 through the support structure 6 up to a double-position change carriage 310 which receives the used cartridges extracted from the rolling mill and after a translation along an axis parallel to the rolling axis X brings the new cartridges into position to be inserted via the device 300 into the housing 4 by pulling them through the structure 6.

Figure 10:
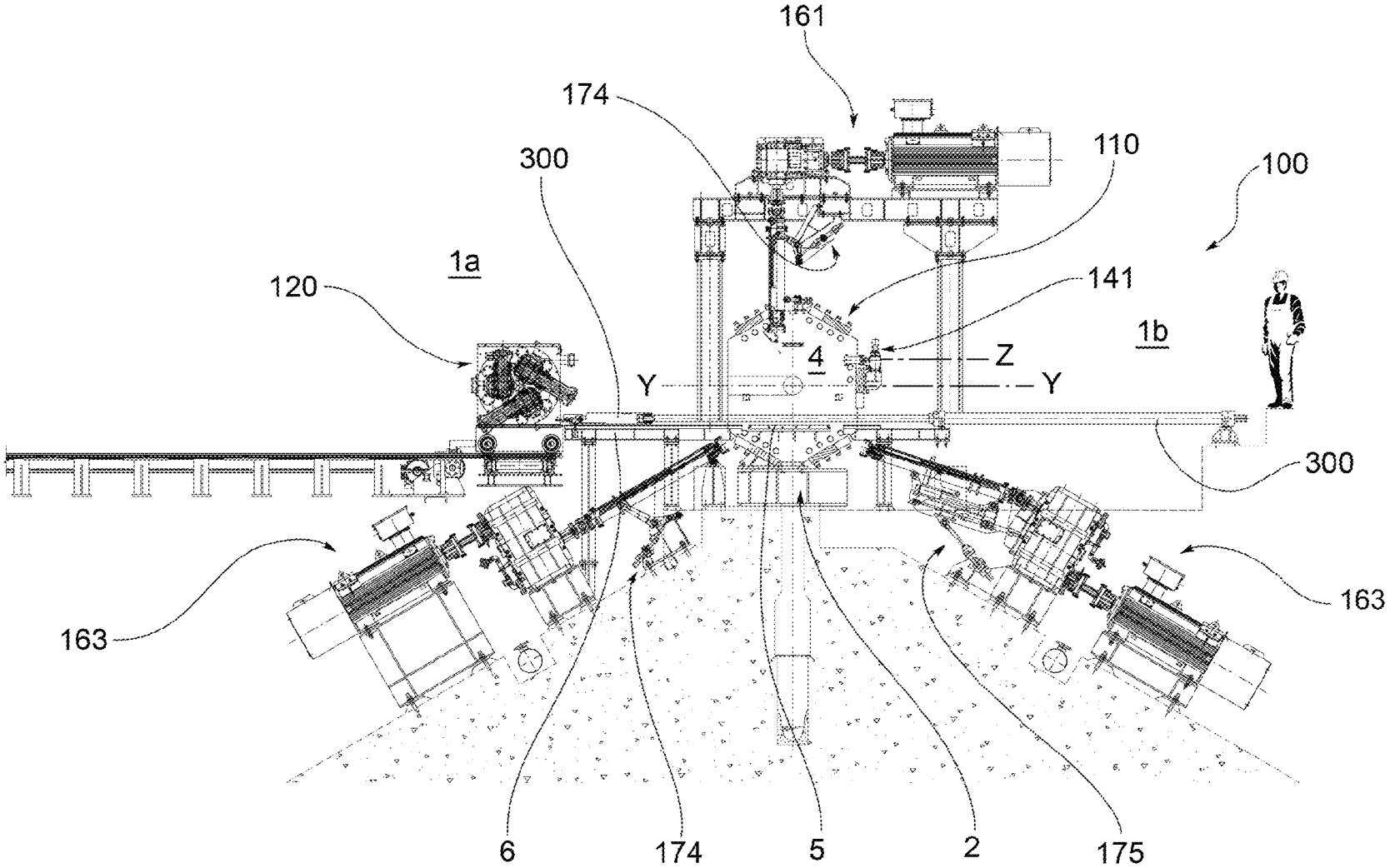
FIG. 10 shows the same sectional view of the rolling station of FIG. 8, wherein the station is shown with the relative roll-holder cartridge in the extracted position, operatively disconnected from the control system and from the actuation device of the roll adjustment system.

Preferably, as illustrated for example in FIG. 10, the same carriage 310 may be directly connected to a maintenance workshop by a rail transport system.

Advantageously, each cartridge 120, 220 is provided with a system for detecting the radial position of the respective rolls, so that it is possible to adjust the action of the synchronized mechanical adjustment system of the rolls. Advantageously, by virtue of the fact that the radial positioning of the rolls is synchronized, such detection system may comprise a single linear transducer or a single angular encoder (associated with one of the rolls), which uniquely detects the angle of rotation of the adjustment system on the cartridge.

The invention allows numerous advantages to be obtained which have been explained in the course of the description.

The rolling mill 1 for solid elongated products according to the invention combines the possibility of extracting all the cages from the same side with a simplified roll control system which does not require special angular gearboxes.

The rolling mill 1 for solid elongated products according to the invention is also constructively simple to manufacture, with substantially lower manufacturing costs than traditional solutions which allow the extraction of all the cartridges from the same side of the rolling mill, especially in consideration of the fact that the gearboxes of the rolling mill according to the invention are standard and therefore readily available on the market with decidedly lower costs. There is also an additional advantage related to the position of the lower gearboxes. The latter, being far from the rolling axis and therefore from the source of heat, water and flakes of the rolling mill, are more reliable and moreover more easily accessible in case of maintenance.

The invention thus conceived therefore achieves its intended purposes.

Obviously, in its practical embodiment, it may also assume forms and configurations different from the one illustrated above without thereby departing from the present scope of protection.

Moreover, all details may be replaced by technical equivalent elements and the dimensions, the forms and the materials employed may be any, depending on the needs.

The invention claimed is:

1. A rolling mill for solid elongated products, defining a rolling axis, comprising a first plurality of rolling stations and a second plurality of rolling stations placed in series along the rolling axis alternated with each other between an input and an output of the rolling mill, wherein each of said rolling stations comprises:

a load-bearing structure;

a roll-holder cartridge removably connected to the load-bearing structure in an extraction direction and comprising three rolling rolls mounted on the roll-holder cartridge to be radially mobile with respect to the rolling axis, the three rolls being rotatable around three respective axes of rotation placed at 120° from each other, one of said rolls having the respective axis of rotation arranged vertically and the other two of said rolls having their respective axes of rotation inclined with respect to vertical;

a system for synchronized mechanical adjustment of all three rolls mounted on board the roll-holder cartridge and operable, in use, to act on said rolls to maintain a predefined radial distance of the rolls from the rolling axis;

an actuator for actuating the synchronized mechanical adjustment system, the actuator being mounted on the load-bearing structure of the roll-holder cartridge;

a coupling body connected to the actuator and a kinematic connection element mechanically synchronized with the three rolls, the coupling body and the actuator rotating about an axis extending along a coupling direction and being configured to engage by coupling the synchronized mechanical adjustment system along the coupling direction;

three gear motor groups connected to the rolls by single extensions to provide the rolls with rotation and torque necessary to force a product to advance along the rolling axis;

wherein a position of the rolls of said second plurality of stations is rotated by 60° around the rolling axis with respect to a position of the rolls of said first plurality of stations so that the rolls with a vertical axis of the first plurality of stations are arranged on a first side of the rolling mill and the rolls with a vertical axis of the second plurality of stations are arranged on a second side of the rolling mill, opposite the first side with respect to the rolling axis;

wherein all the rolling stations of said rolling mill are configured to allow lateral extraction of the respective roll-holder cartridges from a same side of the rolling mill, corresponding either to said first side or to said second side;

wherein all the rolling stations have respective actuators for actuating the synchronized mechanical adjustment system either mounted in a fixed manner on the load-bearing structure of the roll-holder cartridge if the respective actuators are positioned on the side of the rolling mill opposite the cartridge extraction side and have the coupling direction parallel to the extraction direction, or movably mounted on the load-bearing structure of the roll-holder cartridge if the respective actuators are positioned with the coupling direction intersecting the extraction direction, said respective actuators being movable in order to disengage the respective synchronized mechanical adjustment systems and release the cartridge extraction path;

wherein the single extensions of all the rolling stations are movable with respect to the load-bearing structures in order to disengage the respective rolls and free the cartridge extraction path.

2. The rolling mill according to claim 1, wherein the single extensions are axially aligned with the rotation axes of the respective rolls when operatively connected to the respective rolls.

3. The rolling mill according to claim 1, wherein the single extensions associated with the rolls with a vertical axis are axially arranged vertically and are associated with the respective gear motor groups, wherein angular gearboxes have an input shaft and an output shaft forming a 90° angle between the input shaft and the output shaft or have the input shaft and the output shaft parallel to each other.

4. The rolling mill according to claim 3, wherein the single extensions are configured to slide along the gearbox shaft of the respective gear motor group in order to uncouple from a hub of the respective roll.

5. The rolling mill according to claim 1, wherein the single extensions associated with the rolls with inclined axes are associated with the respective gear motor groups, wherein the angular gearboxes have the input shaft and the output shaft parallel to each other.

6. The rolling mill according to claim 1, wherein the single extensions of all the rolling stations are translatable along their axis with respect to the load-bearing structures in order to disengage the respective rolls and free the respective cartridges for extraction.

7. The rolling mill according to claim 6, wherein the single extensions are telescopic and translation movement along an axis of the single extensions is obtained with a sliding movement of the relative telescopic structure.

8. The rolling mill according to claim 1, wherein in all the rolling stations at least one of the single extensions is subjected to a rototranslation movement to disengage the respective roll and free the respective cartridge for extraction.

9. The rolling mill according to claim 1, wherein the gear motor groups of all the rolling stations are mounted fixed on support bases.

10. The rolling mill according to claim 1, wherein each rolling station comprises a movement device to move the respective cartridge along the extraction path.

11. The rolling mill according to claim 10, wherein said movement device is placed on the side of the rolling mill opposite the cartridge extraction side.

12. The rolling mill according to claim 10, wherein said movement device comprises at least one hydropneumatic cylinder.

13. The rolling mill according to claim 1, wherein the synchronized mechanical adjustment system comprises second, third fourth and fifth connection elements, the connection elements mounted to a circular crown and arranged in a hexagonal shape.

14. The rolling mill according to claim 1, wherein engagement between the actuator and the coupling body comprises toothed portions.

15. The rolling mill according to claim 1, wherein for each roll, the synchronized mechanical adjustment system comprises a bush, wherein the bushes are kinematically connected.

16. The rolling mill according to claim 15, wherein the connection element is rotatably connected with one of the bushes.

17. The rolling mill according to claim 1, wherein each of the rolling stations has a single actuator.

* * * * *